US006695573B2

(12) United States Patent
Snider

(10) Patent No.: US 6,695,573 B2
(45) Date of Patent: Feb. 24, 2004

(54) HAND-HELD TURBINE POWER TOOL

(75) Inventor: Philip Arnold Snider, Hicksville, OH (US)

(73) Assignee: Cooper Technologies Company, Houston, TX (US)

( * ) Notice: Subject to any disclaimer, the term of this patent is extended or adjusted under 35 U.S.C. 154(b) by 54 days.

(21) Appl. No.: 10/117,525

(22) Filed: Apr. 5, 2002

(65) Prior Publication Data

US 2003/0190228 A1 Oct. 9, 2003

(51) Int. Cl.[7] ..... F01D 1/18

(52) U.S. Cl. ..... 415/1; 415/80; 415/25; 415/904; 137/50; 418/236; 60/436

(58) Field of Search ..... 415/1, 80, 82, 415/904, 25, 36, 30, 26, 141; 137/50, 54, 57, 580; 418/236, 266; 60/436

(56) References Cited

U.S. PATENT DOCUMENTS

| | | | | |
|---|---|---|---|---|
| 3,071,115 A | | 1/1963 | Schott | |
| 3,578,872 A | | 5/1971 | McBurnie | |
| 3,733,143 A | | 5/1973 | Theis, Jr. | |
| 3,945,757 A | | 3/1976 | Cummens | |
| 4,087,198 A | | 5/1978 | Theis, Jr. | |
| 4,465,443 A | | 8/1984 | Karden | |
| 4,540,337 A | | 9/1985 | Olsen | |
| 4,776,752 A | | 10/1988 | Davis | |
| 5,186,603 A | | 2/1993 | Kishi | |
| 5,261,233 A | * | 11/1993 | Kishi | 60/436 |
| 5,496,173 A | | 3/1996 | Wohlgemuth | |
| 5,567,154 A | | 10/1996 | Wohlgemuth | |
| 5,697,773 A | * | 12/1997 | Mendoza et al. | 418/236 |
| 5,984,654 A | * | 11/1999 | Mendoza et al. | 418/236 |
| 6,029,695 A | * | 2/2000 | Logan | 137/580 |
| 6,179,552 B1 | | 1/2001 | Jacobsson | |
| 6,241,464 B1 | | 6/2001 | Huffaker et al. | |

* cited by examiner

*Primary Examiner*—Edward K. Look
*Assistant Examiner*—J. M. McAleenan
(74) *Attorney, Agent, or Firm*—Coats & Bennett, P.L.L.C.

(57) ABSTRACT

A turbine tool design with a number of innovative aspects which may be incorporated into the tool individually or as a group. One aspect relates to improved speed control, based on an elastically deformable governor member disposed within the rotating impeller assembly and having a substantially uniform cross-section. Another aspect relates to a overspeed safety configuration that employs secondary, or "retro", nozzles that are enabled when the elastically deformable governor member is removed from the impeller assembly. Another aspect relates to routing the motive fluid exhaust through the operator-adjustable throttle assembly. Still another aspect relates to an approach to axially preloading the bearings supporting the rotating shaft of the impeller assembly.

29 Claims, 8 Drawing Sheets

HAND-HELD TURBINE POWER TOOL

BACKGROUND OF THE INVENTION

The present invention relates generally to hand-held rotary tools, and more particularly to the construction of, and/or the control of pressurized fluid flowing through, a rotary turbine tool.

Air motors are conventionally used to drive high speed hand-held rotary tools, such as grinders and drills, because the air motor is suitable for light work and relatively safe. Unfortunately, many air motors of the prior art have poor speed regulation, with speed tending to drop drastically in the face of torque loading. Efforts have been made to improve speed regulation, with less than ideal results. For instance, U.S. Pat. No. 3,071,115 to Schott discloses one prior art approach for controlling the speed of a pneumatic rotation motor. The Schott approach relies on mechanical flyweights for both a speed governor and an overspeed safety device. While both the Schott governor and the overspeed safety device are disposed within the motor, the Schott rotor design as a whole is rather complicated, requires a relatively large radial space, and is difficult to adapt to very fast rotating motors. Particularly in high speed applications, the centrifugal forces acting on the flyweights and other parts in the Schott design place high demands on the dimensions and material of the flyweight springs, etc., increasing costs.

More recently, U.S. Pat. No. 6,241,464 to Huffaker discloses a rotary turbine tool with an approach to speed control that relies on the interplay of a complex elastomeric valve member and a plurality of valve guides to control airflow, with no back-up form of overspeed protection.

Thus, there remains a need for alternate rotary tool designs, particularly for alternative hand-held rotary turbine tool designs.

SUMMARY OF THE INVENTION

The present invention provides an improved hand-held turbine tool design with a number of innovative aspects which may be incorporated into the tool individually or as a group. One aspect of the present invention relates to improved speed control based on an elastically deformable governor member disposed within the rotating impeller assembly and having a substantially uniform cross-section. Another aspect of the present invention relates to an overspeed safety configuration that employs secondary, or "retro", nozzles that are enabled when the elastically deformable governor member is removed from the impeller assembly. Another aspect of the present invention relates to routing the motive fluid exhaust through the operator-adjustable throttle assembly. Still another aspect of the present invention relates to a simplified method of axially preloading the bearings supporting the rotating shaft of the impeller assembly.

DETAILED DESCRIPTION

Figure 1:
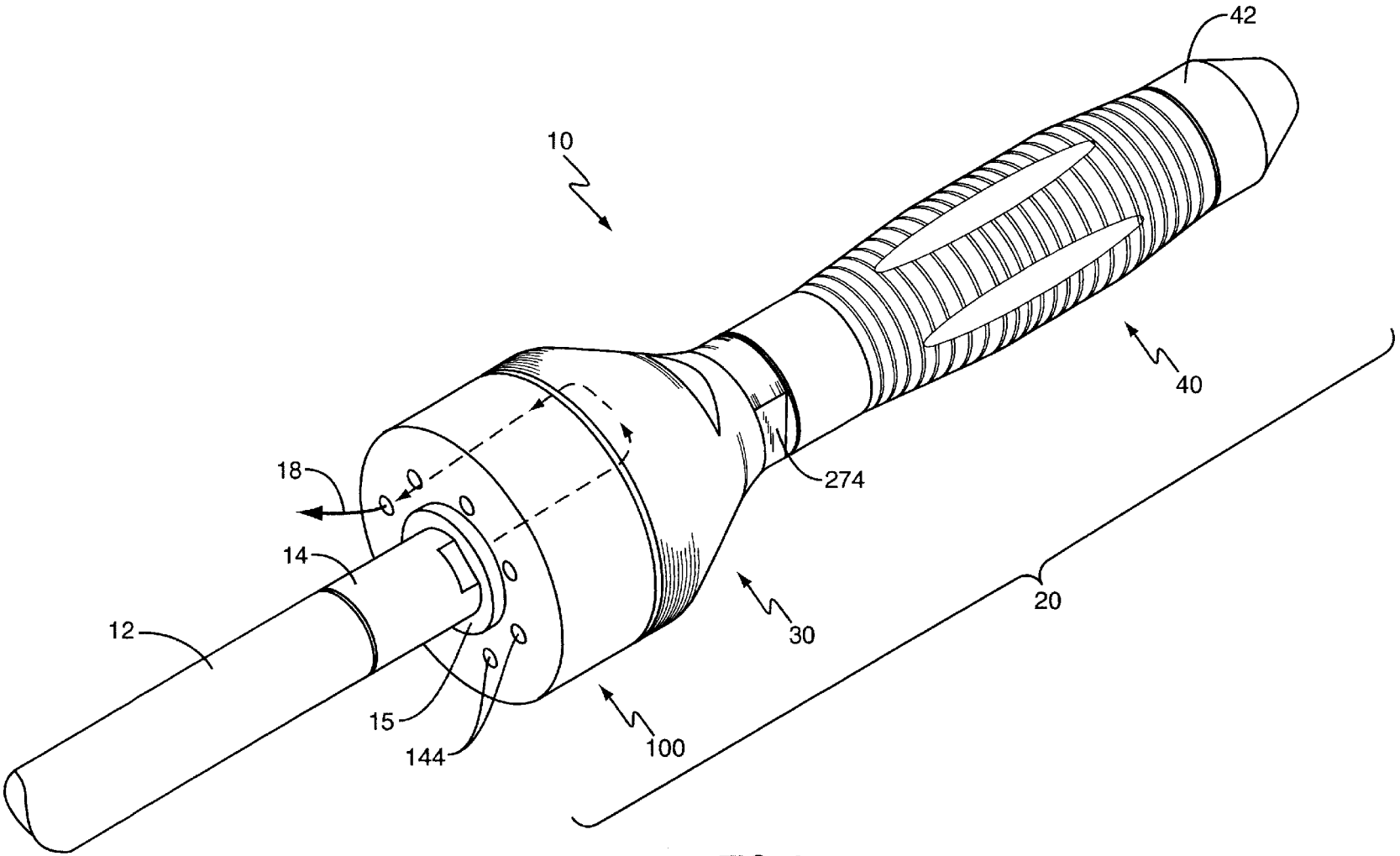
FIG. 1 shows a perspective view of one embodiment of the hand-held turbine tool of the present invention.

One embodiment of the hand-held turbine tool 10 of the present invention is shown in FIG. 1. The turbine tool 10 is pneumatically powered, typically by compressed air supplied via a hose 12 that is coupled to the housing 20 via hose coupler 14. The housing 20 typically includes three parts: a main body 30, a throttle assembly 100, and a handle portion 40. The housing 20 operatively supports a rotating impeller assembly 200 (see FIGS. 4–5), and defines a fluid flow path 18 therewith, as described more fully below. The rotation of the impeller assembly 200 rotates the drill bit, rotary file, or the like, mated to the operative end of the tool 10, as is well known in the art. The supply of pressurized air to the impeller assembly 200 is controlled via the throttle assembly 100 of the housing 20. Rotation of a portion of the throttle assembly 100 in one direction closes off the supply of pressurized air to the impeller assembly 200, while rotation in the opposite direction opens the supply of air to the impeller assembly 200. The distal handle portion 40 of the tool 10 allows for easy hand-held operation by a user.

The main body 30 of the housing 20 is threadably coupled on one end to the throttle assembly 100, and on the other end to the handle portion 40. Preferably, the main body 30 is a hollow body with a tapered profile that tapers from the relatively larger diameter of the throttle assembly 100 to the narrower diameter of the handle portion 40. The front of the main body includes an opening 32, having a bearing, referred to as the rear bearing 34, disposed therein. An elastically deformable cushion element 38, typically in the form of an O-ring, is placed between the front (handle) side of the rear bearing 34 and a corresponding seating shoulder in the main body 30. See FIG. 4. In addition, another cushion element 36 may be placed radially between the outer race of the rear bearing 34 and the main body 30. The function of these cushions 36,38 is discussed further below. The main body 30 of the housing 20, and particularly the rear bearing 34, cooperates with the handle portion 40 to support the impeller assembly 200 for rotation.

Figure 2:
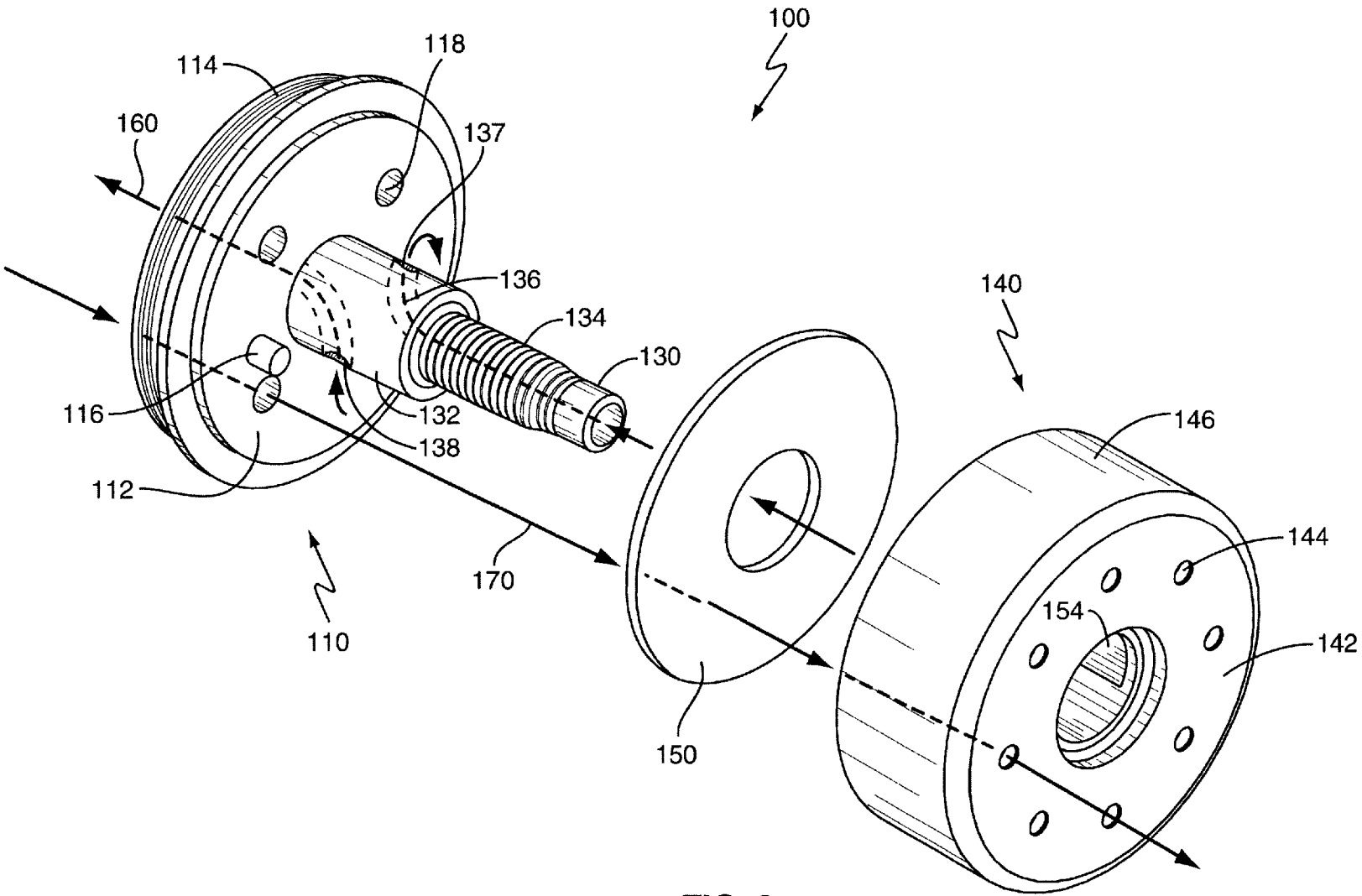
FIG. 2 shows a exploded view of a throttle assembly useful in the present invention.
Figure 3:
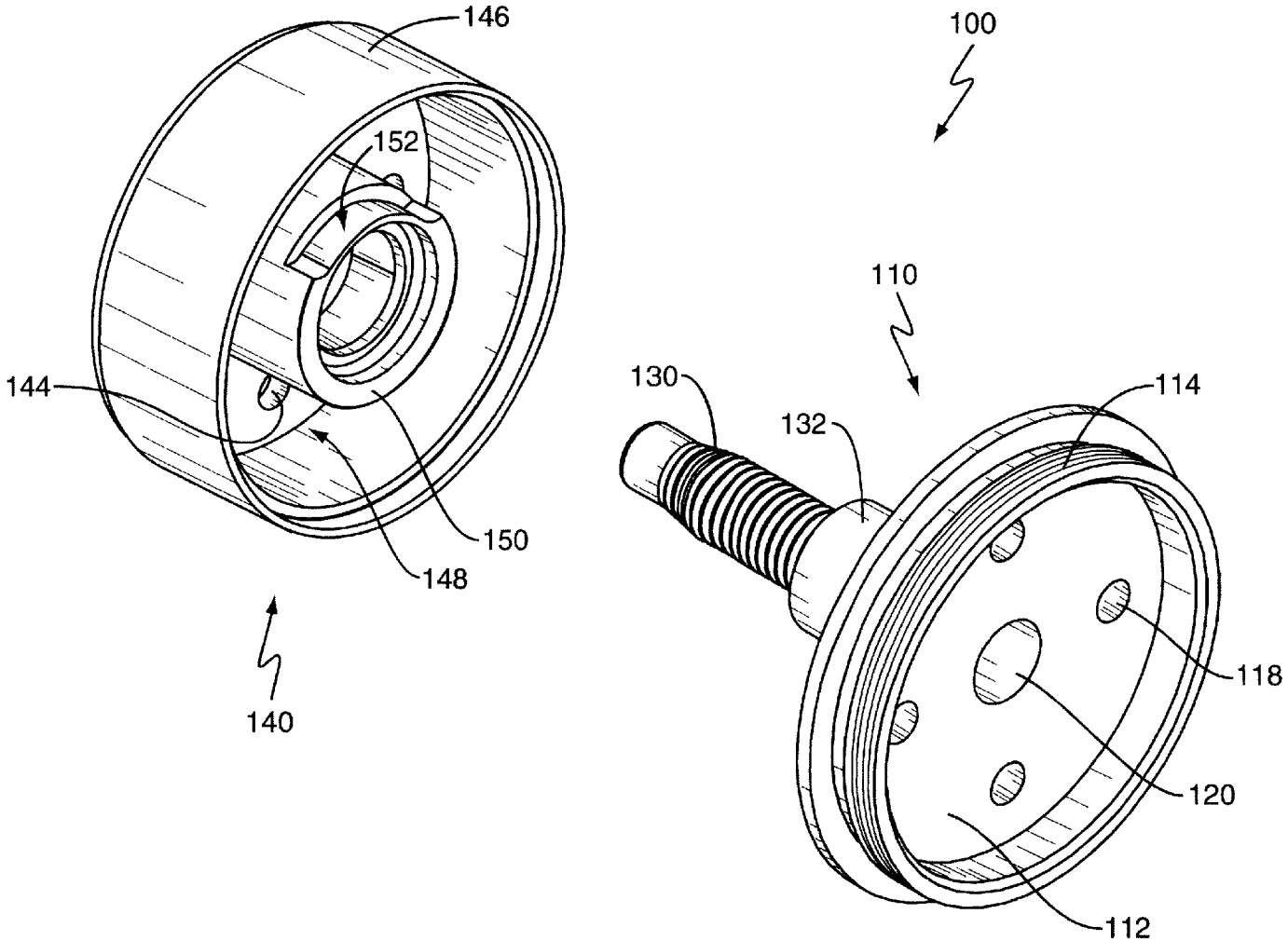
FIG. 3 shows another exploded view of the throttle assembly of FIG. 2.

As mentioned above, the throttle assembly 100 regulates the flow of pressurized air from the hose 12 to the impeller assembly 200. To accomplish this, the throttle assembly 100 may be composed of a stationary throttle base portion 110 and a throttle cap 140 rotatably coupled thereto, as shown in FIGS. 2–3. The throttle base 110 includes a generally disc-shaped base 112 and a post 130 extending therefrom. The base 112 includes external threads 114 on its distal side for mating with the housing's main body 30, a pin 116 on its proximal side, and a plurality of holes 118 that pass from one side of the base 112 to the other. In addition, the base 112 includes an outlet 120 aligned with the central axis of the throttle base 110. The post 130 of the throttle base 110 extends away from the base 112 on the proximal side thereof, also along the central axis of the throttle base 110. This post 130 includes a shoulder section 132 proximate the base 112, and a hollow threaded section 134. A passage 136 for the input of pressurized air is at least partially defined by the hollow. The passage 136 continues into the shoulder section 132 and terminates at a passage outlet 137 that is oriented generally radially outward. Located on the shoulder section 132 approximately 180° from the outlet passage 137 is a transfer passage 138, angled downward and inward, and terminating at the throttle assembly outlet 120 on the distal side of the base 112. The throttle assembly outlet 120 directs the pressurized air from the throttle assembly 100 into the impeller assembly 200, and preferably extends at least partially into the impeller assembly 200 when the turbine tool 10 is assembled, but allows rotation therebetween.

The throttle cap 140 includes a generally annular section 142 joining an embossment 150 with a peripheral wall 146, thereby forming a generally C-shaped cross-section on its underside. The open space of this C-shaped cross-section may be referred to as the "muffle space" 148. A plurality of exhaust holes (or "exhaust ports") 144 extend through the annular section 142, thereby connecting the exterior of the throttle cap 140 to the muffle space 148. The embossment 150 includes an outer recess 152 on its outer perimeter that extends in an arc of approximately 90°. Located generally opposite this outer recess 152, and on the interior surface of the embossment 150, is a transfer recess 154 that extends in an arc of approximately 270°.

Both the throttle base 110 and throttle cap 140 of the throttle assembly 100 are preferably made from a strong lightweight material, such as aluminum. However, it may be advantageous for the outlet 120 feeding the impeller assembly 200 to be formed at least in part by an inert made from a suitable low-friction plastic material, such as Teflon or nylon.

The throttle cap 140 is joined to the throttle base 110 by sliding the appropriate portion of the post 130 through the center of the hollow embossment 150, aligning the parts such that the pin 116 fits within the outer recess 152 of the embossment 150, and thereafter screwing the hose coupling 14 onto the post 130. Suitable O-rings (not shown) may be disposed at the base of the post 130 to mate with the embossment 150 of the throttle cap 140, and at the interface between the peripheral wall 146 of the throttle cap 140 and the throttle base 110, both with corresponding seating recesses as desired. There may also be a suitable O-ring (not shown) disposed at the interface of the post 130 and the throttle cap 140, proximate the hose coupling 14. In addition, there may be a suitable washer, such as a plastic washer 15, disposed between the hose coupling 14 and the throttle cap 140 (see FIG. 1).

The joining of the throttle cap 140 to the throttle base 110 forms an inlet airflow path 160 and an exhaust airflow path 170 within the throttle assembly 100, with these airflow paths 160,170 jointly forming portions of the overall airflow path 18 of the turbine tool 10. The inlet airflow path 160 flows through the passage 136 of the post 130 and out the passage outlet 137, into the transfer recess 154 in the embossment 150 of the throttle cap 140, across the transfer recess 154, and into the transfer passage 138, and then out the outlet 120 to the impeller assembly 200. The exhaust airflow path 170 of the throttle assembly 100 flows through the holes 118 in the throttle base 110, into the muffle space 148 formed on the underside of the throttle cap 140, and then out the exhaust holes 144 of the throttle cap 140.

While the throttle cap 140 is rotationally coupled to the throttle base 110, the degree of relative rotation therebetween limited by the interaction of the pin 116 and the outer recess 152 on the embossment 150. It is intended that interior surface of the embossment 150 block the entrance to the transfer passage 138 when the throttle cap 140 is rotated with respect to the throttle base 110 such that the pin 116 is located towards one end of the outer recess 152. In this "off" throttle setting, the flow path between the passage outlet 137 and the transfer passage 138 is blocked, cutting off pressurized airflow to the impeller assembly 200. When the operator rotates the throttle cap 140 relative to the throttle base 110 such that the pin 116 is moved substantially towards the opposite end of the outer recess 152, at least a portion of the entry to the transfer passage 138 in the throttle base 110 is thereby aligned with the transfer recess 154 in the embossment 150. In this configuration, the passage outlet 137 is connected to the transfer passage 138 via the transfer recess 154 on the interior surface of the embossment 150, allowing pressurized air to flow from the hose 12 to the throttle assembly outlet 120, and therefore to the impeller assembly 200. Thus, the supply of pressurized air from the hose 12 to the impeller assembly 200 may be throttled via the relative rotation of the throttle cap 140 with respect to the throttle base 110.

Figure 4:
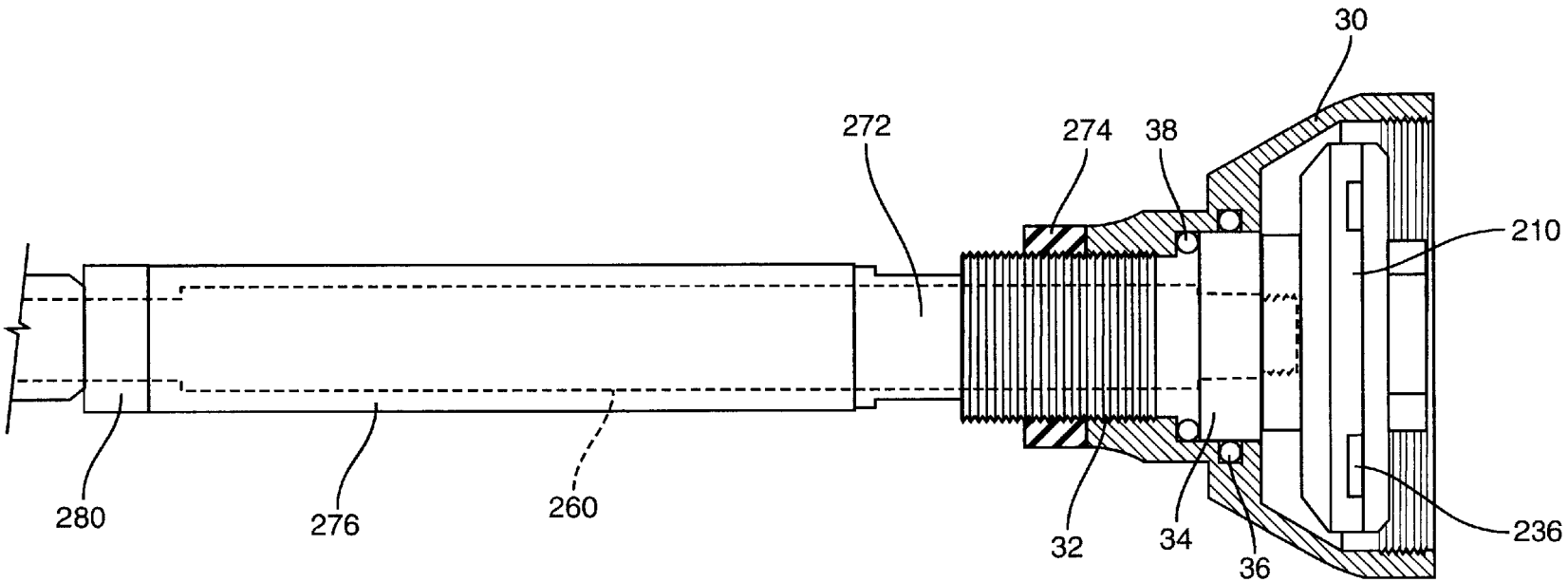
FIG. 4 shows a view of the relationship between an impeller assembly and a main body for one embodiment of the present invention.
Figure 5:
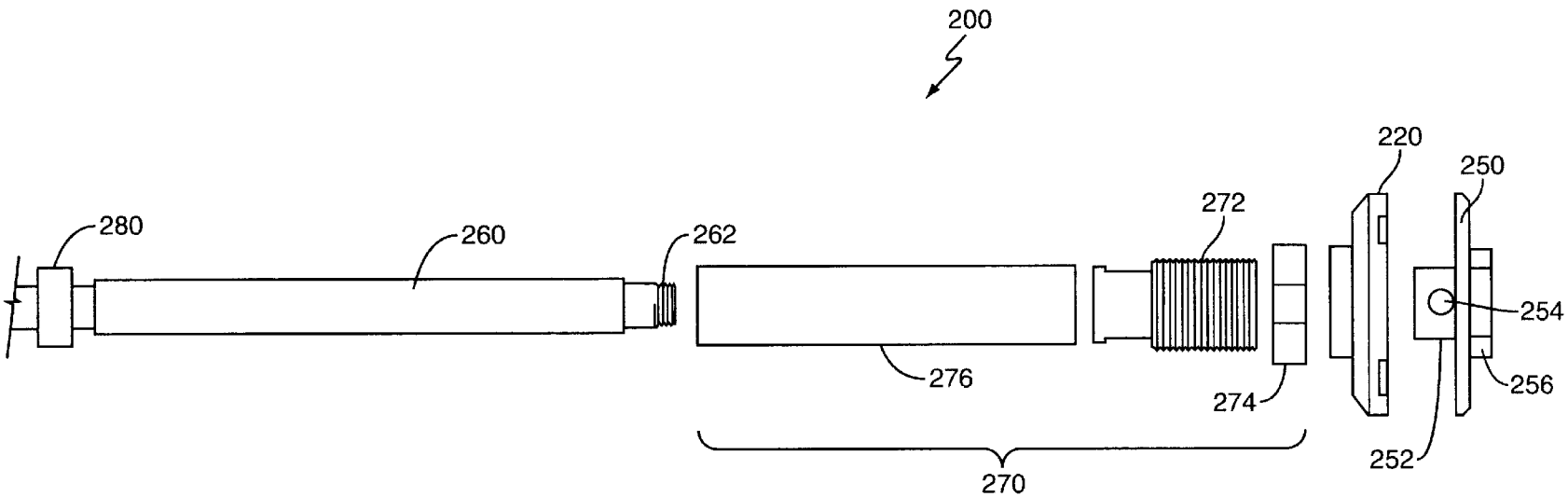
FIG. 5 shows an exploded view of an impeller assembly useful in the present invention.
Figure 6:
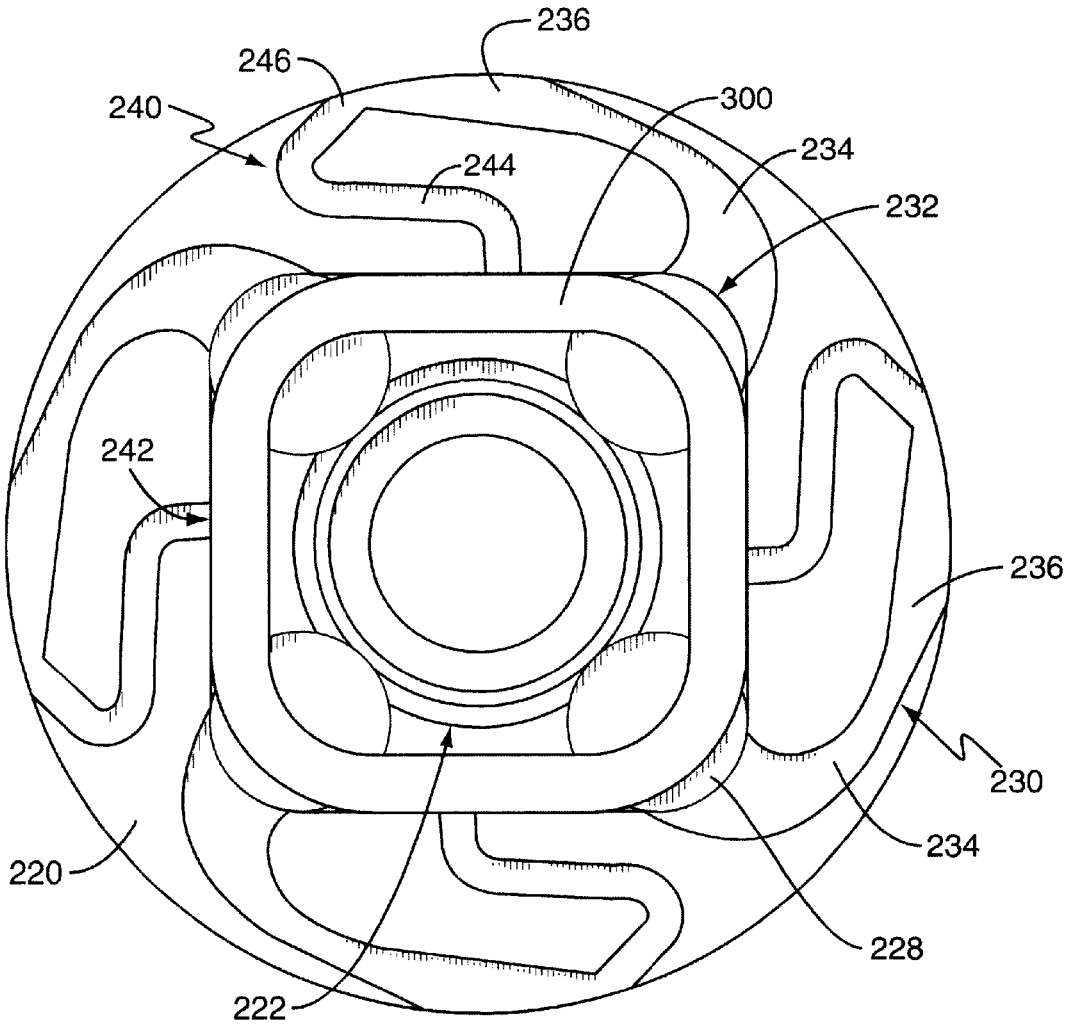
FIG. 6 shows a view of a manifold according to one embodiment of the present invention.
Figure 7:
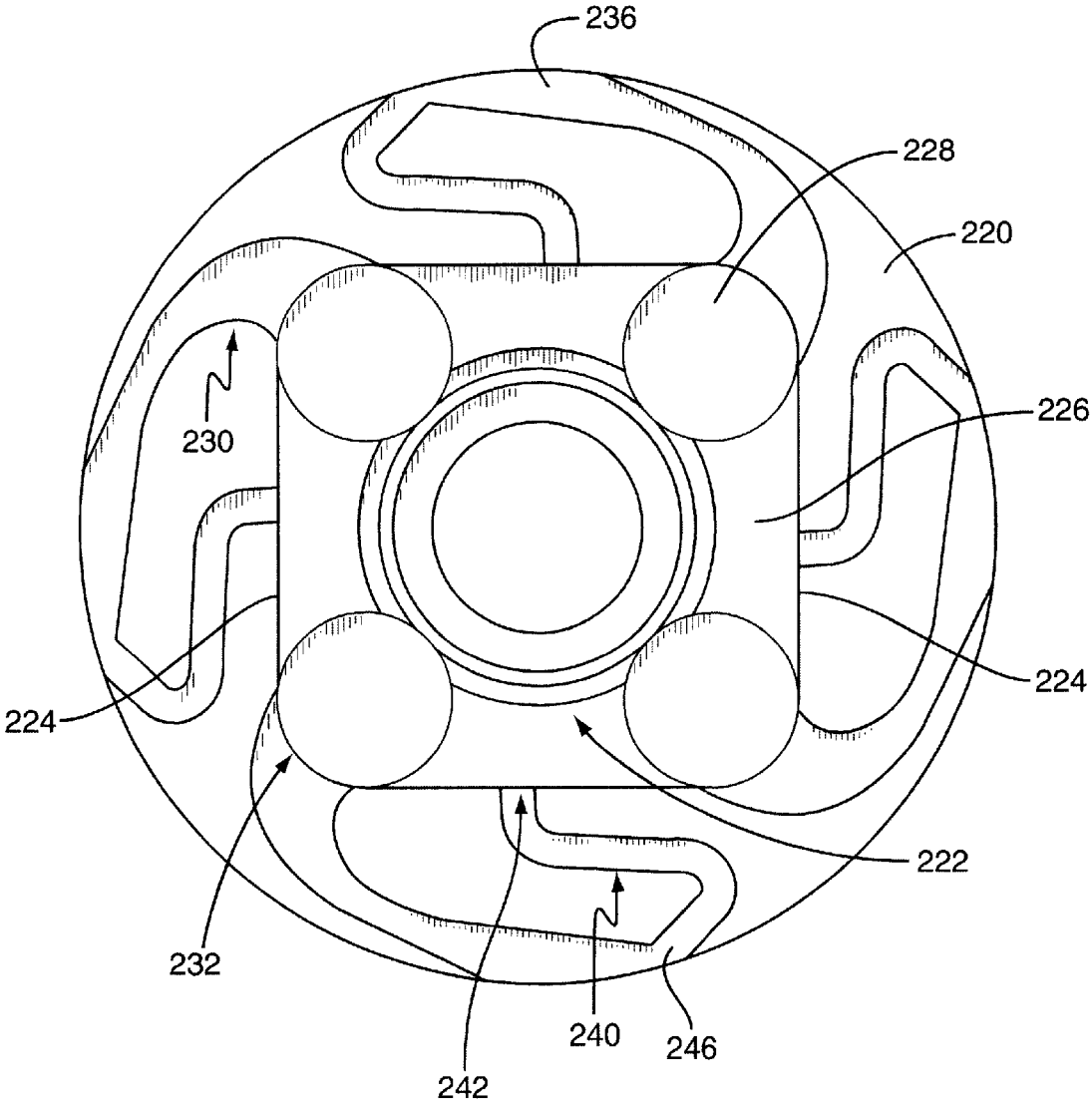
FIG. 7 shows a view of the manifold of FIG. 6 with the governor removed.

Referring to FIGS. 4–7, the impeller assembly 200 includes a rotating impeller body 210, a spindle (or "shaft") 260 mated to the impeller body 210, a sleeve assembly 270, and a front bearing 280. The impeller body 210 includes a manifold 220 and a cap 250. The manifold 220 includes a central chamber 222 that connects to both primary nozzles 230 and to secondary nozzles 240. Note that some embodiments of the present invention may have only one primary port 230 and no secondary ports 240; although a plurality of each in equal numbers is believed advantageous. The primary nozzles 230 include primary ports 232, primary passages 234, and primary jets 236. Likewise, the secondary nozzles 240 include secondary ports 242, secondary passages 244, and secondary jets 236. The primary nozzles 230 and secondary nozzles 240 may be constant width or may vary in shape so as to be subsonic or supersonic, as desired. As can be seen in FIGS. 6–7, the primary nozzles 230 and secondary nozzles 240 need not be of the same size/shape; indeed, it is believed advantageous if the primary nozzles 230 are larger in size than the secondary nozzles 240. In addition, the primary jets 236 and the secondary jets 246 may generally face each other at the exterior of the manifold 220, or they may be spaced apart as desired. The primary nozzles 230 are oriented to urge the impeller body 210 to rotate in a first direction when pressurized air flows therethrough, while the secondary nozzles 240 are oriented to urge the impeller body 210 to rotate in a second direction, opposite the first direction, when pressurized air flows therethrough.

The central chamber 222 may include a central circular recess area corresponding to the post 252 of the cap 250, and be generally defined by a peripheral wall 224. The ports 232,242 associated with the nozzles 230,240 are located at select locations along the peripheral wall 224. As described above, the group of primary ports 232 correspond to the input ends of the primary nozzles 230 and the group of secondary ports 242 correspond to the input ends of the secondary nozzles 240. The central chamber 222 may advantageously have a generally rectangular outline with rounded corners. The primary ports 232 may advantageously be located in the corners, with the secondary ports 242 being located mid-way along each side. See FIG. 7. Further, it may be advantageous to provide additional shallow recesses 228 at each corner, with these recesses 228 extending below the nominal "floor" of the chamber 222. The "floor" between the recesses 228 may be thought of as a shelf 226 that runs along the interior of the peripheral wall 224.

The annular cap 250 has a generally smooth underside, with a hollow post 252 extending therefrom. The hollow post 252 is internally threaded and includes a inlet jet 254 oriented radially outward. The impeller body 210 is assembled and mated to the spindle 260 by securely threading the hollow post 252 of the cap 250 onto the threaded end 262 of the spindle 260, capturing the manifold 220 against the proximal side of the inner race of rear bearing 34. Suitable torque may be applied to the cap 250 through the use of a faceted embossment 256 on the upper side of the cap 250, if desired. With the cap 250 screwed in place, the impeller body 210 is rotationally coupled to the spindle 260, such that rotation of the impeller body 210 causes rotation of the spindle 260. Air flow from the throttle assembly outlet 120 enters chamber 222 via the hollow post 252 and inlet jet 254.

The spindle 260 coupled to the impeller body 210 is supported for rotation by a front bearing 280 and the rear bearing 34, with the outer race of the rear bearing 34 secured to the main body 30 and the inner race of the front bearing 280 secured to the spindle 260 via any known technique. The bearings 34,280 should be subjected to an axial preload, such as a preload of approximately four pounds, and may be conventional or thrust bearings as desired. This axial preload may be accomplished in some embodiments of the present invention via simple adjustment of the sleeve assembly 270. The sleeve assembly 270 is disposed generally about the spindle 260 and may include a threaded portion 272 and a spacer portion 276 disposed between the threaded portion 272 and the front bearing 280. As shown in FIG. 4, the spindle 260 extends forwardly out the opening 32 in the main body 30 of the housing 20 and through the threaded portion 272. The opening 32 is interiorly threaded to mate with the threaded portion 272. The threaded portion 272 includes external threads and optional flats for aid in screwing the threaded portion 272 into and out of the opening 32 in the main body 30. When the threaded portion 272 is screwed out of the main body 30, it will eventually push against the spacer portion 276, forcing the spacer portion 276 to abut against the front bearing 280. This action has the effect of axially displacing the impeller assembly 200 forward with respect to the main body 30. This movement has the effect of bringing the forward portion of the impeller body 210 into contact with the back side of the rear bearing 34, urging the rear bearing 34 to move forward relative to the main body 30. Forward movement of the rear bearing 34 compresses the cushion 38, the elastic properties thereof providing the axial preload to the rear bearing 34. In addition, this axial preload is also applied to the front bearing 280 due to the now-fixed relationship between the impeller body 210 and the front bearing 280, via the spindle 260. When the desired amount of axial preload is reached, perhaps as measured by the torque necessary to unscrew the threaded portion 272, a suitable lock nut 274 may be put in place against the front "nose" of the main body 30. In this fashion, the effective length of the sleeve assembly 270 may be adjusted to apply the desired preload in a very simple manner.

It should be noted that it is not necessary, or even desirable, for the sleeve assembly 270 to touch the spindle 260, except through the outer race of front bearing 280, so as to allow for free rotation of the spindle 260 without wearing against the sleeve assembly 270. Further, the presence of cushion 36 helps discourage small relative movements of the outer race of the rear bearing 34 and/or a relatively non-wearing surface if such movements do occur.

When the throttle is open, the pressurized air from the inlet airflow path 160 of the throttle assembly 100 is supplied to the impeller assembly 200. The drive air flows from the outlet 120 of the throttle assembly 100 into the chamber 222 of the impeller body 210 via the inlet jet 254. The pressurized air within the chamber 222 is restrained between the cap 250 and the manifold 220, and is thereby directed from the chamber 222 to the nozzles 230,240. Assuming for the moment that the pressurized air is leaving the impeller body 210 only through the primary nozzles 240, the flow of air through the primary nozzles 240 causes the impeller body 210 to rotate, thereby rotating the spindle 260 in a "drive" direction. As the impeller body 210 sits mostly within the main body 30 of the housing 20 (see FIG. 4), the pressurized air exiting the impeller assembly 200 flows between the impeller assembly 200 and the main body 30 of the housing 20. This "exhaust" air is routed out of the main body 30 via the holes 118 in the throttle base 112, and from there to the exhaust holes 144 via the muffle space 148. As can be seen, the impeller assembly 200 and the housing 20 cooperate to form an fluid flow path 18 within the turbine tool 10, with this fluid flow path 18 including the inlet airflow path 160 through the throttle assembly 100, the air flow path through the impeller body 210 (e.g., the central chamber 222, the primary nozzles 230 (and perhaps secondary nozzles 240)), flow through the cavity within the main body 30 surrounding the impeller body 210, and the exhaust airflow path 170 within the throttle assembly 100.

In order to control the rotational speed, the impeller assembly 200 of the present invention advantageously includes an elastically deformable speed control member 300, sometimes referred to herein as the governor. This governor 300 advantageously has a uniform cross-section, and may take the form of a common rubber-like O-ring. The governor 300 is disposed within the chamber 222 of the impeller body 210 and should be sized such that it preferably rests against the peripheral wall 224, on the shelf 226 within the chamber 222, except at the primary ports 232 leading to the primary jets 236 (e.g., the corners, see FIG. 6). The uniform cross-section of the governor 300, in an undeformed state, may advantageously be equal to or slightly larger than the height between the self 226 and the underside of the cap 250, so that flow "over" the governor 300 is prevented.

At low rpms the pressurized air entering into the chamber 222 flows through the chamber 222, around the governor member 300, such as through the recesses 228 proximate the primary ports 232, through the relatively substantial gap between the governor 300 and the primary ports 232, and then to the primary jets 236 via the primary ports 232 and primary passages 234. With the governor 300 against the peripheral wall 224 of the chamber 222, particularly in the neighborhood of the secondary ports 242, the secondary ports 242 are directly blocked by the governor 300; as such, there should not be pressurized air being expelled out the secondary nozzles 240. As the rotational speed increases, the governor 300 is centrifugally deformed. Because the governor 300 is already disposed against the peripheral wall 224 of the chamber 222 for most of its length, the deformation is limited to distention of the governor 300 towards the primary ports 232, thereby lessening the physical gap between the governor 300 and the primary ports 232 and gradually restricting the flow of pressurized air into the primary nozzles 230. At some point, the centrifugal force acting on the governor 300 will be balanced by the elastic properties of the governor 300, and the rotational speed of the impeller assembly 200 will stabilize. Thereafter, when an additional load is applied to the tool 10, for instance during grinding, the rotational speed of the impeller assembly 200 will drop, thereby lessening the centrifugal force on the governor 300. With the drop in centrifugal force, the distention of the governor 300 will lessen, thereby opening up the gap at the primary ports 232 and increasing the airflow through the primary nozzles 230, increasing rotational speed until the forces balance again. Thus, the governor 300 helps control the rotational speed of the impeller assembly 200, and practically applies an upper limit thereto.

The secondary nozzles 242 in the impeller body 210 of some embodiments of the present invention provide an independent overspeed safety backup that limits the maximum rotational speed of the impeller assembly 200 separately from the action of governor 300 described above. If the unit is assembled without the governor 300, or if the governor 300 disintegrates for unknown reasons, then the chamber 222 will operatively communicate with the secondary nozzles 240 via the secondary ports 242, as the secondary ports 242 are not blocked by the governor 300. In such a situation, the flow of pressurized air out of chamber 222 would be split between the primary nozzles 230 and the secondary nozzles 240. Because the primary nozzles 230 and the secondary nozzles 240 are oriented so as to urge the impeller body 210 to rotate in opposite directions, the airflow through the respective nozzles 230,240 will counteract each other, at least to some extent. With the resultant forces in opposition, the maximum rpm of the impeller assembly 200 will be limited, with the maximum rpm of the impeller assembly 200 being less with the secondary ports 242 open than with the secondary ports 242 closed. In this sense, the secondary nozzles 240 may be considered as "retro" nozzles, as they act to retard the runaway rotation of the impeller assembly 200 that might otherwise occur. Accordingly, the presence of the secondary nozzles 240, normally inactive when the governor 300 is present but active if the governor 300 is missing, provides additional overspeed protection, separate from that provided by the governor 300.

The handle portion 40 of the housing 20 is typically rather elongate, with a plastic exterior contoured for easy handling by an operator. The handle portion 40 may mate to the main body 30 via the sleeve assembly 270, such as by screwing onto the distal threads of the threaded portion 272. The handle portion 40 may also include a collet 42 or guard on its distal end, as is known in the art. One function of the handle portion 40 is to support the front bearing 280 of the impeller assembly 200; thus, the handle portion 40 cooperates with the main body 30 to support the impeller assembly 200 for rotation.

Some embodiments of the present invention may include a muffling material 150, disposed within the muffle space 148, just upstream from the exhaust holes 144, to aid in quieting the exhaust from the tool 10. This muffling material 150 may take the form of a felt washer pressed against the underside of the throttle cap 140, or may take other forms.

Figure 8:
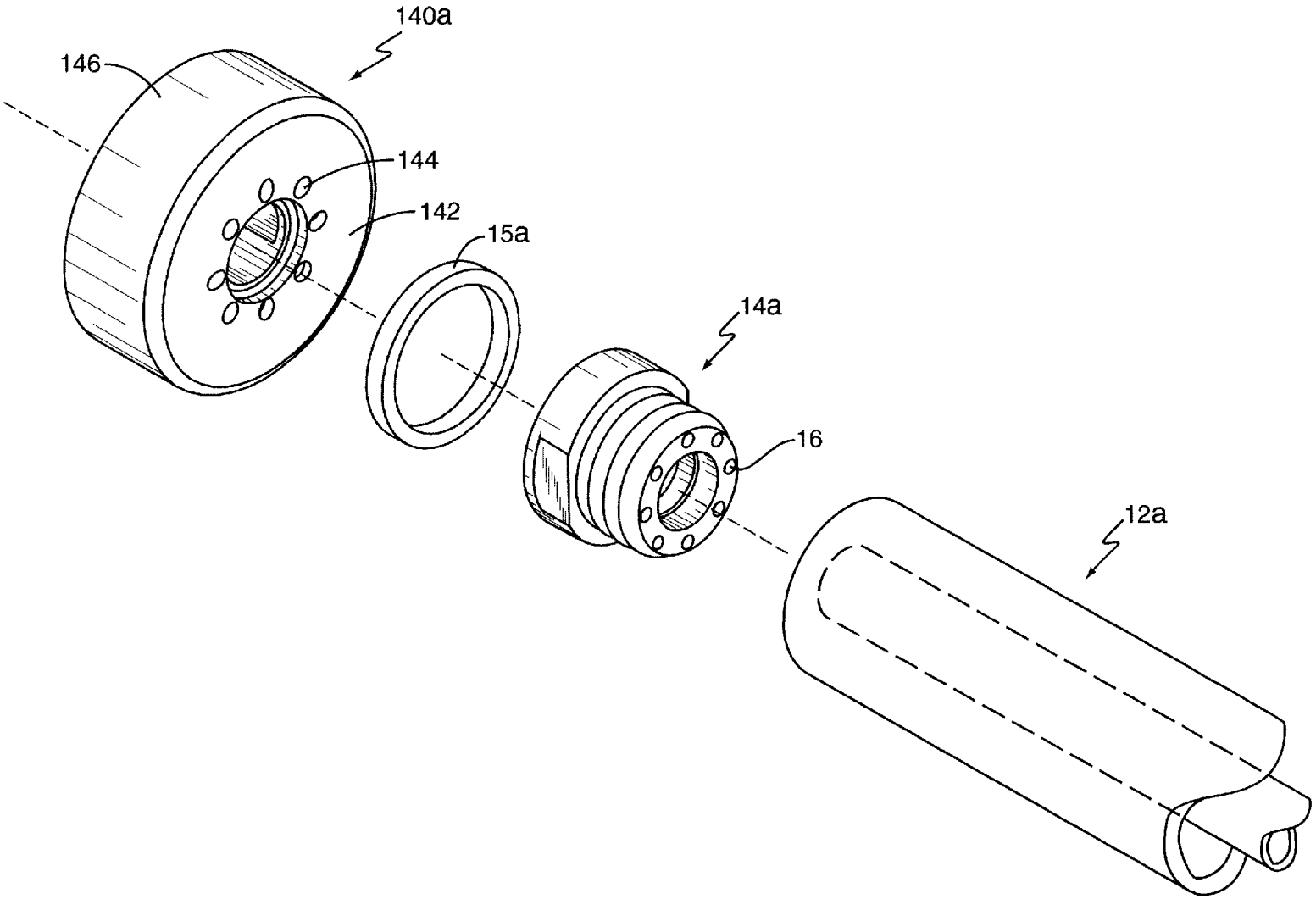
FIG. 8 shows an alternate "overhose" coupling of a hose to a throttle assembly.

The discussion above has assumed that the hose 12 carried the pressurized motive gas into the turbine tool 10, but that the exhaust gas was exhausted directly to the ambient environment by the throttle assembly 100. However, alternate embodiments of the present invention may use what is commonly referred to as an "overhose" arrangement, where the hose 12 also carries away the exhaust gas. For instance, see the embodiment of FIG. 8. In such an arrangement, the cap 140*a* of the throttle assembly 100*a* will still have exhaust holes 144, but the exhaust holes 144 will be moved radially inward with respect to the throttle cap 140 of FIGS. 2–3. Indeed, the exhaust holes 144 should be very closely spaced with respect to the edge of the embossment 150. A dual layer hose 12*a* is mated to an overhose adapter 14*a* in a conventional fashion. The adapter 14*a* includes a central hole for the inflowing air, and a plurality of apertures 16 for exhaust air. The apertures 16 are radially spaced similarly to the exhaust holes 144 of the cap 140*a*, so that air exiting the throttle assembly 100*a* will flow into the apertures 16, through the adapter 14*a*, and then into the outer layer of hose 12*a*, and eventually exhausted from the hose 12*a* appropriately. A suitable seal 15*a*, with an inner diameter greater than the ring of apertures 16 but less than the outer diameter of the adapter 14*a* should be employed to prevent the escape of exhaust from between the cap 140*a* and the adapter 14*a*.

A turbine tool 10 according to the present invention and suitable for operation at approximately 65,000 rpm based on a supply pressure of ninety psig may employ an aluminum impeller body 210 with a roughly square chamber 222 having peripheral walls 224 spaced approximately 0.604 inches apart; with round recesses 228 having a diameter of approximately 0.188 inches and a depth of approximately 0.125 inches (from the top of the peripheral walls 224); a shelf depth of approximately 0.050 inches; a buna N governor 300 of 90 durometer (Shore A) with approximately 0.551 inches inner diameter in an undeformed state and a uniform cross-section of approximately 0.070 inches in an undeformed state; and an outer diameter of the manifold 220 of approximately 0.125 inches. Such a turbine tool 10 may have a maximum rpm of approximately 35,000 when the governor 300 is not present in the chamber. The distal end of the spindle 260 of such a turbine tool 10 may be adapted to mate with any appropriate drill bits, rotary files, or the like, in any fashion known in the art.

While the discussion above has been in terms of using pressurized air as a motive fluid, it should be understood that the present invention also encompasses using any gas, not just air. For example, the motive fluid may be nitrogen or other inert gas if desired.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A turbine tool, comprising:

a rotatable impeller comprising:

a central chamber;

at least one primary nozzle oriented to urge said impeller to rotate in a first direction when fluid is expelled therethrough; and at least one secondary nozzle oriented to urge said impeller to rotate in a second direction, opposite said first direction, when fluid is expelled therethrough;

a speed control member resiliently deformable when disposed in said chamber to control the amount of fluid expelled via said at least one primary nozzle in response to changes in rotational speed of said impeller;

wherein drive fluid supply to said at least one secondary nozzle is generally blocked when said speed control member is present in said chamber, but generally open when said speed control member is not present in said chamber.

2. The tool of claim 1 wherein said chamber is generally peripherally defined by a chamber wall, said at least one primary nozzle, and said at least one secondary nozzle, said speed control member disposed to generally block said at least one secondary nozzle.

3. The tool of claim 1 wherein said impeller comprises at least two of said primary nozzles and at least two of said secondary nozzles.

4. The tool of claim 1 wherein said impeller comprises an equal number of primary nozzles and secondary nozzles.

5. The tool of claim 1 wherein, given a fixed available fluid supply rate, a maximum rotation speed of said impeller is a first value with said speed control member is disposed in said chamber and a second value with said speed control member not disposed in said chamber, said first value being more than said second value.

6. The tool of claim 1 wherein drive fluid supply to said at least one secondary nozzle is directly blocked by said speed control member when said speed control member is present in said chamber.

7. The tool of claim 1 wherein:

said impeller comprises at least two of said primary nozzles and at least two of said secondary nozzles;

said chamber is generally peripherally defined by a chamber wall, said at least one primary nozzle, and said at least one secondary nozzle;

said speed control member disposed to directly block said at least one secondary nozzle; and wherein given a fixed available fluid supply rate, a maximum rotation speed of said impeller is a first value with said speed control member not in said chamber and a second value with said speed control member disposed in said chamber, said first value being less than said second value.

8. The tool of claim 1 wherein said at least one primary nozzle and said at least one secondary nozzle directly connect to said chamber via corresponding ports thereof.

9. A method of controlling the rotational speed of a turbine tool, comprising:

providing an impeller supported for rotation about an axis and comprising:

a central chamber;

at least one primary nozzle oriented to urge said impeller in a first direction when fluid is expelled therethrough; and at least one secondary nozzle oriented to urge said impeller in a second direction, opposite said first direction, when fluid is expelled therethrough;

routing drive fluid through said at least one primary nozzle and blocking flow through said at least one secondary nozzle when a speed control member is disposed in said chamber, said speed control member resiliently deformable to control the amount of fluid expelled via said at least one primary nozzle in response to changes in rotational speed of said impeller when disposed in said chamber;

routing drive fluid through both said at least one primary nozzle and said at least one secondary nozzle when said speed control member is not present in said chamber;

wherein, given a fixed available drive fluid supply rate, a maximum rotation speed of said impeller is a first value with said speed control member disposed in said chamber and a second value with said speed control member not disposed in said chamber, said first value being more than said second value.

10. The method of claim 9 further comprising directly blocking flow through said at least one secondary nozzle with said speed control member when said speed control member is present in said chamber.

11. A turbine tool, comprising:

an impeller having a central chamber and supported for rotation, said chamber having an inlet disposed radially inward;

said impeller further having at least two primary outlet nozzles disposed radially outward of said inlet and bordering said chamber, said primary nozzles oriented to urge said impeller to rotate in a first direction when fluid is expelled therethrough;

a speed control member having a substantially uniform cross-section and disposed generally between said inlet and said primary nozzles, said speed control member resiliently deformable in response to changes in rotational speed of said impeller to control fluid flow through said primary nozzles.

12. The tool of claim 11 wherein said speed control member comprises a generally ring shaped member in an undeformed state.

13. The tool of claim 12 wherein said generally ring shaped member is an O-ring.

14. The tool of claim 11 wherein said impeller further comprises at least one secondary nozzle oriented to urge said impeller in a second direction, opposite said first direction, when fluid is expelled therethrough and bordering said chamber; wherein airflow communication between said inlet and said at least one secondary nozzle is generally blocked by said speed control member.

15. The tool of claim 14 wherein said impeller comprises at least two of said secondary nozzles.

16. A turbine tool, comprising:

a housing adapted for hand operation;

a fluid supply hose coupled to said housing;

a fluid driven impeller disposed within said housing and supported for rotation;

said housing having a first portion and a second portion rotatably coupled to said first portion, rotation of said second portion relative to said first portion throttling the supply of motive fluid to said impeller;

said second portion comprising one or more exhaust ports, said housing and said impeller cooperating to form a fluid flow path having said one or more exhaust ports downstream of said impeller;

wherein motive fluid entering said housing and causing rotation of said impeller is exhausted from said housing via said exhaust ports.

17. The tool of claim 16 further comprising a muffling material, said muffling material disposed along said fluid flow path, downstream of said impeller and upstream of said exhaust ports.

18. The tool of claim 17 wherein said muffling material comprises a felt disc.

19. The tool of claim 16 further comprising a hose coupled to said second housing portion, said hose comprising a first layer supplying said motive fluid to said housing and a second layer carrying exhaust fluid away from said exhaust ports.

20. The tool of claim 16 wherein said motive fluid is exhausted directly to the ambient environment via said exhaust ports.

21. A turbine tool, comprising:

a housing and a sleeve coupled to said housing;

a fluid driven impeller shaft disposed in said sleeve and said housing;

said shaft supported for rotation by at least a first bearing and a second bearing, said first bearing disposed internal to said housing, said a second bearing attached to said shaft in spaced relation to said first bearing and abutting said sleeve;

a first resiliently compressible material disposed between said first bearing and said second bearing, and axially between said first bearing and said housing;

wherein an axial preload on said first and second bearings may be adjusted by adjusting said sleeve relative to said housing, thereby adjusting a compression of said first resiliently compressible material.

22. The tool of claim 21 further comprising a second resiliently compressible material disposed radially between said first bearing and said housing.

23. The tool of claim 21 wherein said sleeve comprises an externally threaded portion and a spacer portion, said threaded portion mated to said housing, said spacer portion disposed between said externally threaded portion and said second bearing and abutting said second bearing.

24. The tool of claim 23 wherein said axial preload on said first and second bearings may be adjusted up or down by adjusting said sleeve outward or inward with respect to said housing, respectively, thereby adjusting said a compression of said first resiliently compressible material.

25. The tool of claim 21 wherein said first resiliently compressible material comprises an elastomeric ring.

26. A turbine tool, comprising:

a housing and a sleeve coupled to said housing;

a rotatable impeller having:

a central chamber with a fluid inlet;

at least one primary nozzle oriented to urge said impeller to rotate in a first direction when fluid is expelled therethrough;

at least one secondary nozzle oriented to urge said impeller to rotate in a second direction, opposite said first direction, when fluid is expelled therethrough; and a shaft disposed in said sleeve and said housing;

a speed control member resiliently deformable when disposed in said chamber to control the amount of fluid expelled via said at least one primary nozzle in response to changes in rotational speed of said impeller;

wherein drive fluid supply to said at least one secondary nozzle is generally blocked when said speed control member is present in said chamber, but generally open when said speed control member is not present in said chamber;

said shaft supported for rotation by at least a first bearing and a second bearing, said first bearing disposed internal to said housing, said second bearing attached to said shaft in spaced relation to said first bearing and abutting said sleeve;

a first resiliently compressible material disposed between said first bearing and said second bearing, and axially between said first bearing and said housing;

wherein an axial preload on said first and second bearings may be adjusted by adjusting an amount of extension of said sleeve relative to said housing, thereby adjusting a compression of said first resiliently compressible material.

27. The tool of claim 26 further comprising:

a fluid supply hose coupled to said housing;

wherein said housing has a first portion and a second portion rotatably coupled to said first portion, rotation of said second portion relative to said first portion throttling the supply of motive fluid to said impeller;

said second portion comprising one or more exhaust ports, said housing and said impeller cooperating to form a fluid flow path having said one or more exhaust ports downstream of said impeller;

wherein motive fluid entering said housing and causing rotation of said impeller is exhausted from said housing via said exhaust ports.

28. The tool of claim 27 further comprising a muffling material, said muffling material disposed along said fluid flow path, downstream of said impeller and upstream of said exhaust ports.

29. The tool of claim 26 wherein said speed control member comprises an elastomeric ring.

* * * * *